US010501982B2

(12) United States Patent
Kronenberg

(10) Patent No.: US 10,501,982 B2
(45) Date of Patent: Dec. 10, 2019

(54) PLUG-IN CONNECTOR

(71) Applicant: Ralf M. Kronenberg, Haan (DE)

(72) Inventor: Ralf M. Kronenberg, Haan (DE)

( * ) Notice: Subject to any disclaimer, the term of this patent is extended or adjusted under 35 U.S.C. 154(b) by 281 days.

(21) Appl. No.: 15/509,325

(22) PCT Filed: Sep. 8, 2015

(86) PCT No.: PCT/EP2015/070438

§ 371 (c)(1),
(2) Date: Mar. 7, 2017

(87) PCT Pub. No.: WO2016/038002

PCT Pub. Date: Mar. 17, 2016

(65) Prior Publication Data

US 2017/0260797 A1 Sep. 14, 2017

(30) Foreign Application Priority Data

Sep. 8, 2015 (DE) ..... 20 2014 104 222

(51) Int. Cl.
*E06B 3/667* (2006.01)
*E06B 3/663* (2006.01)

(52) U.S. Cl.
CPC ..... *E06B 3/667* (2013.01); *E06B 3/66314* (2013.01)

(58) Field of Classification Search
CPC ..... E06B 3/667; Y10T 403/55
See application file for complete search history.

(56) References Cited

U.S. PATENT DOCUMENTS

2011/0041427 A1* 2/2011 Bouesnard ..... E06B 3/66309 52/171.3

FOREIGN PATENT DOCUMENTS

| | | | | |
|---|---|---|---|---|
| DE | 297 22 771 U1 | | 6/1999 | |
| DE | 20 2004 013686 U1 | | 2/2006 | |
| DE | 20 2009 008694 U1 | | 12/2010 | |
| DE | 20 2012 102380 U1 | | 12/2013 | |
| DE | 20 2012 103904 U1 | | 2/2014 | |
| EP | 0 283 689 A2 | | 9/1988 | |
| EP | 2281994 B1 | * | 8/2015 | ..... E06B 3/667 |
| WO | WO-9934083 A1 | * | 7/1999 | ..... E06B 3/667 |
| WO | 2014/001505 A1 | | 1/2014 | |

* cited by examiner

*Primary Examiner* — Matthieu F Setliff
(74) *Attorney, Agent, or Firm* — McGlew and Tuttle, P.C.

(57) ABSTRACT

A plug-in connector (1), for warm edge hollow profiles (2) of spacers of insulating glazing, has a base with side walls (6) at the edges. A plurality of retaining elements (15) formed as spring lugs are arranged on the outer side of the base (bottom) (5) in a single central row on each of both sides of the center (3) of the plug-in connector (1). Starting from the base (5), the retaining elements are directed obliquely outwards towards the adjacent hollow profile base (28) and towards the connector center (3). The retaining elements (15) are in each case arranged in a sunken base region (13) on the outer side of the base (5) that adjoins a raised, plate-like base region (11) arranged in the region of the center (3). Laterally obliquely outwardly directed resilient retaining elements (18,19) are arranged at the free edge region (7) of the side walls (6).

22 Claims, 6 Drawing Sheets

PLUG-IN CONNECTOR

CROSS REFERENCE TO RELATED APPLICATIONS

This application is a United States National Phase Application of International Application PCT/EP2015/070438, filed Sep. 8, 2015, and claims the benefit of priority under 35 U.S.C. § 119 of German Application 20 2014 104 222.9, filed Sep. 8, 2014, the entire contents of which are incorporated herein by reference.

FIELD OF THE INVENTION

The present invention pertains to a plug-in connector for hollow sections, especially warm-edge hollow sections, of spacers of an insulating glazing, wherein the plug-in connector has a bottom (base) with side walls at the edges.

BACKGROUND OF THE INVENTION

Plug-in connectors for hollow sections of spacer frames for insulating glazing are known from practice in various embodiments. These plug-in connectors are designed, as a rule, for mechanically stable hollow sections made of metal. These are, e.g., extruded sections made of light metal or rolled sections or sections manufactured in another manner from steel plate. These plug-in connectors are less suited for more labile hollow sections made of plastic or from a combination of plastic and metal. Such pure plastic sections or combined sections are used for heat insulation purposes and are called warm-edge hollow sections.

SUMMARY OF THE INVENTION

An object of the present invention is to show a plug-in connector that is also suitable for more labile hollow sections of the above-mentioned type.

The resilient retaining elements arranged centrally at the connector bottom (base) and directed outwardly, especially spring bosses, are especially well suited for more labile hollow sections. Due to their central arrangement, they mesh especially favorably with the associated and adjacent hollow section wall. This is preferably the bottom of the hollow section, which points towards the interior space or the inside of the insulating glazing or window pane in the installed position.

The roof of the hollow section is not loaded by the bottom-side retaining elements. In addition, a preferably existing inner cavity of the plug-in connector remains free and permits unhindered flow of a contained granular desiccant over the junction point of the ends of the hollow section.

The central arrangement in a single central row has, in addition, the advantage that the resilient retaining elements can be broadened and reach over a considerable part of the width of the connector. As a result, they can better introduce their supporting and retaining forces into the wall of the hollow section. Identical design of the bottom-side retaining elements among each other is also advantageous for this.

The central arrangement is also advantageous for hollow sections that are configured with a central row of perforations in the longitudinal direction. A connection is established via the perforation hole between the granular desiccant arranged in the hollow sections and the interior space between the panes. In addition, it is favorable if the resilient retaining elements have a straight edge or a concave edge at their free front edge. They mesh with the wall of the hollow section by this front edge.

Possibly existing height tolerances of the hollow section are absorbed and compensated with the resilient retaining elements at the bottom due to the retaining elements yielding resiliently. This can happen without damage, especially without undesired deformation of the hollow section. In addition, it is favorable if the bottom-side retaining elements are arranged in a recessed bottom area. Their projecting length can be increased and their spring action can correspondingly be improved hereby.

The bottom of the connector may have a contoured shape with recessed and raised areas on the outside. Tight contact with the adjacent hollow section bottom can be brought about at the raised areas. On the one hand, this improves the stability and the retention of the plug-in connector in the ends of the hollow section. On the other hand, an undesired flow of granules between the bottoms of the connector and the hollow section can be stopped. Especially favorable is the arrangement of a raised, central plate-shaped area and of end-side, rib-like or web-like elevations of the bottom. An axial recess may be present at the raised areas for receiving a possible row of perforations and arranged preferably centrally at the bottom of the connector.

The plug-in connector may have, further, additional resilient retaining elements, which are directed laterally and obliquely outwardly, at the free edge area of its side walls. These retaining elements mesh with the side walls of the hollow section and may likewise be configured as flexible spring bosses. The retaining elements may have a straight front edge, with which they are in contact with the wall of the hollow section and dig in when a force develops in the extraction direction. The contact is linear, and meshing that is gentle for the material of the retaining element can be obtained despite high effectiveness. The straight front edge is preferably directed at right angles to the bottom of the connector.

To achieve favorable retaining and spring action of the retaining elements for labile hollow sections, especially for warm-edge sections, the retaining elements are advantageously edge-shaped. The retaining elements are tapered at the transition point into the web wall relative to the free front edge, as a result of which greater flexibility is obtained to spare the material of the hollow section.

A central stop is favorable for making it possible to accurately position the ends of the hollow sections, which ends are plugged onto the plug-in connector or the connector leg thereof. The central stop may be arranged on one longitudinal side or on both longitudinal sides of the plug-in connector. The plug-in lengths of the connector legs in the ends f the hollow section and hence the holding action may be essentially equal. With suitable, especially resilient stop elements, the ends of the hollow sections can tightly abut against one another with their end faces at the connection point. As a result, the formation of a gap and escape of granules at the connection or junction point can be avoided or at least minimized. The raised outside bottom areas of the plug-in connector are likewise optimized for avoiding or minimizing the escape of granules.

The plug-in connector is preferably configured as a stamping or bending part made of metal, especially steel plate. As an alternative, it may consist of another material, e.g., plastic or a composite. The plug-in connector is preferably configured as a straight connector, but it may also be configured, as an alternative, as a corner angle.

The present invention is schematically shown in the drawings as an example. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
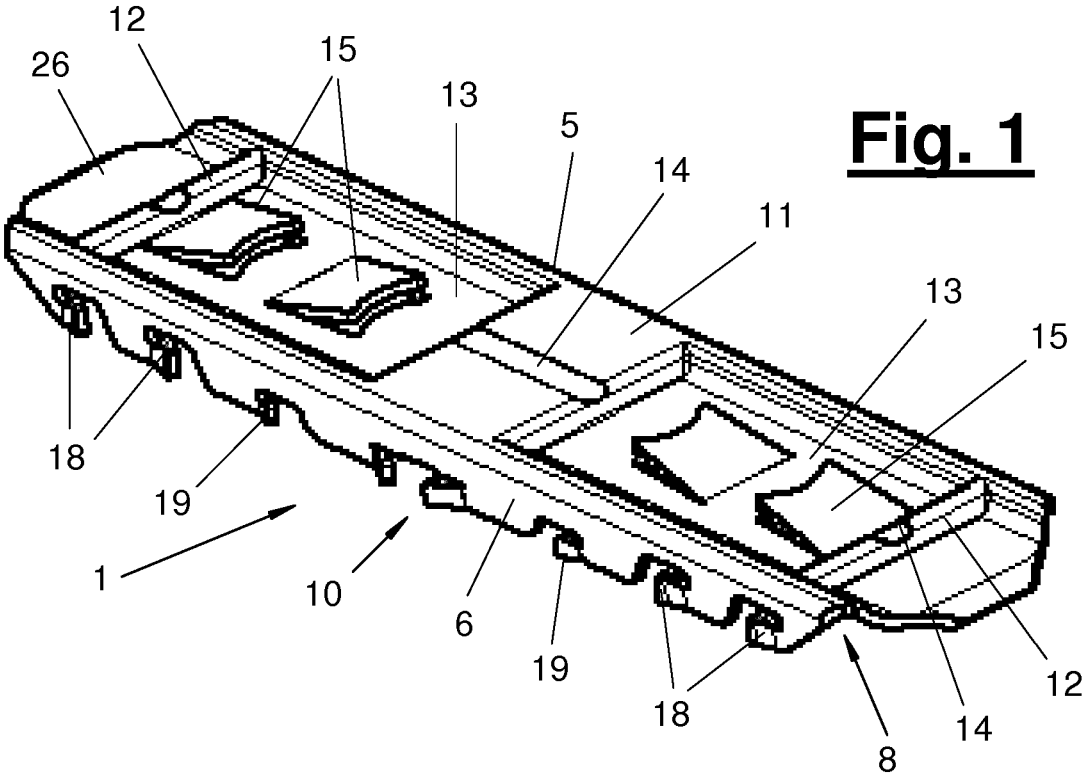
FIG. 1 is a perspective view of a plug-in connector with the view taken obliquely from the top.

Referring to the drawings, the present invention pertains to a plug-in connector (1) for hollow sections or hollow section ends (2) of a spacer for insulating glazing. The present invention pertains, in addition, to a plug-in connection comprising a plug-in connector (1) and plugged-in hollow section ends (2).

Figure 3:
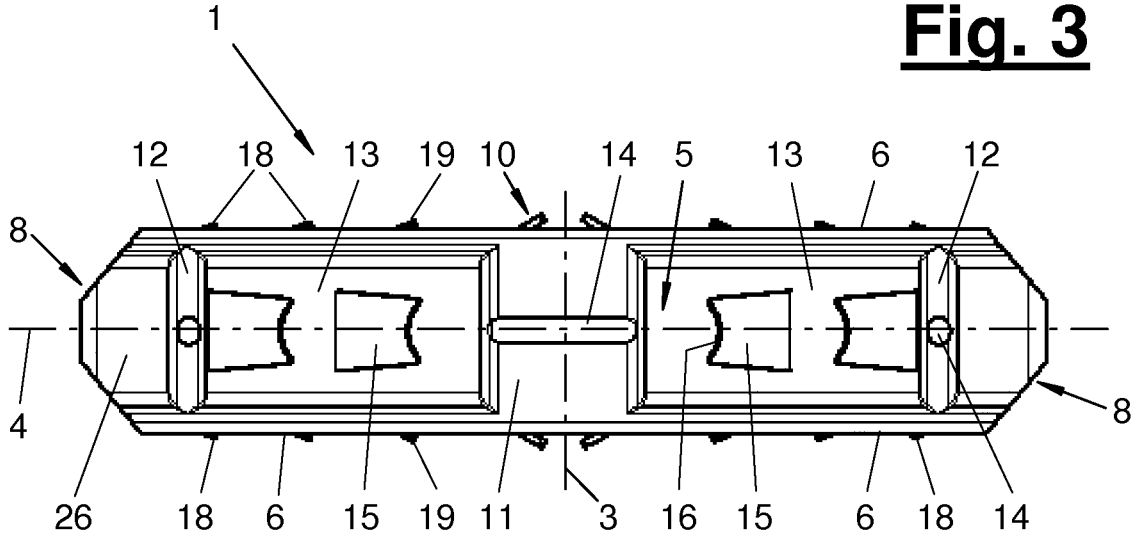
FIG. 3 is a top view of the plug-in connector from FIGS. 1 and 2.
Figure 4:
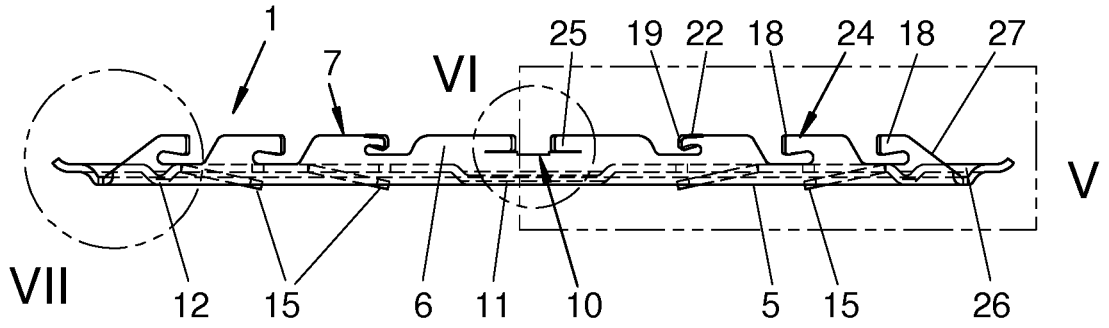
FIG. 4 is a tilted side view of the plug-in connector from FIGS. 1 and 2.
Figure 5:
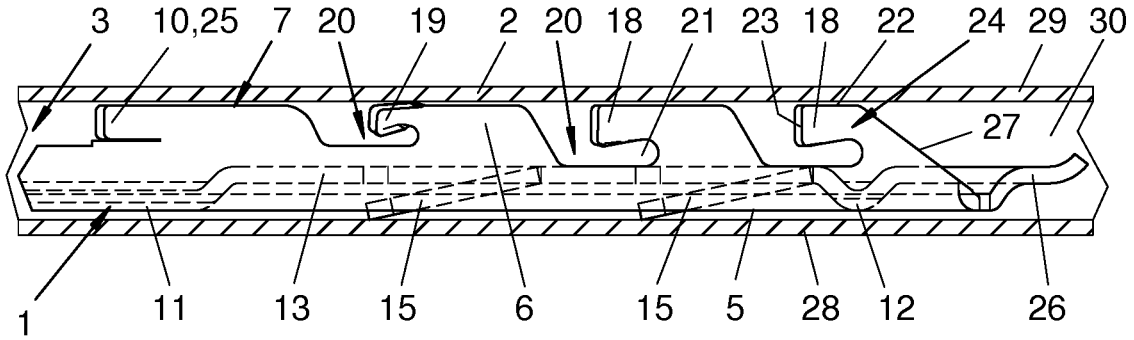
FIG. 5 is a cut-away and enlarged detail view of the plug-in connector from FIG. 4 with a plugged-in hollow section end in a partly cut-away side view.
Figure 8:
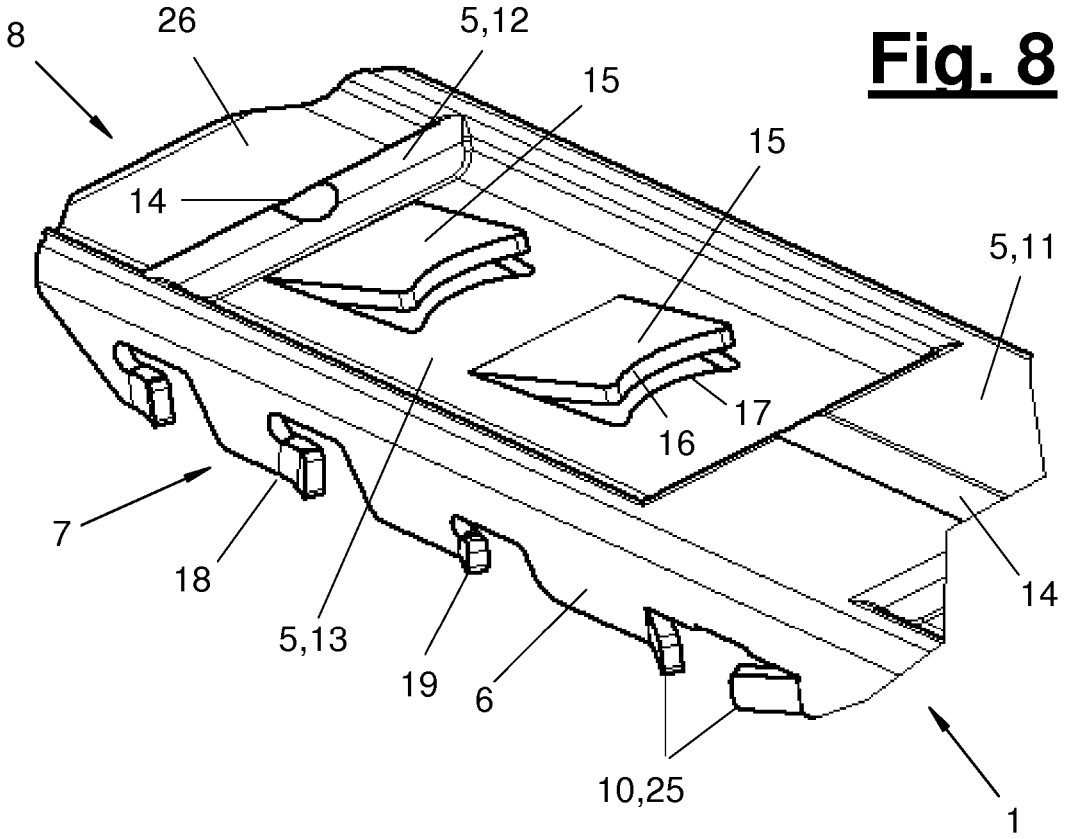
FIG. 8 is a cut-away and enlarged perspective detail view of the underside of the connector with bottom-side retaining elements.
Figure 9:
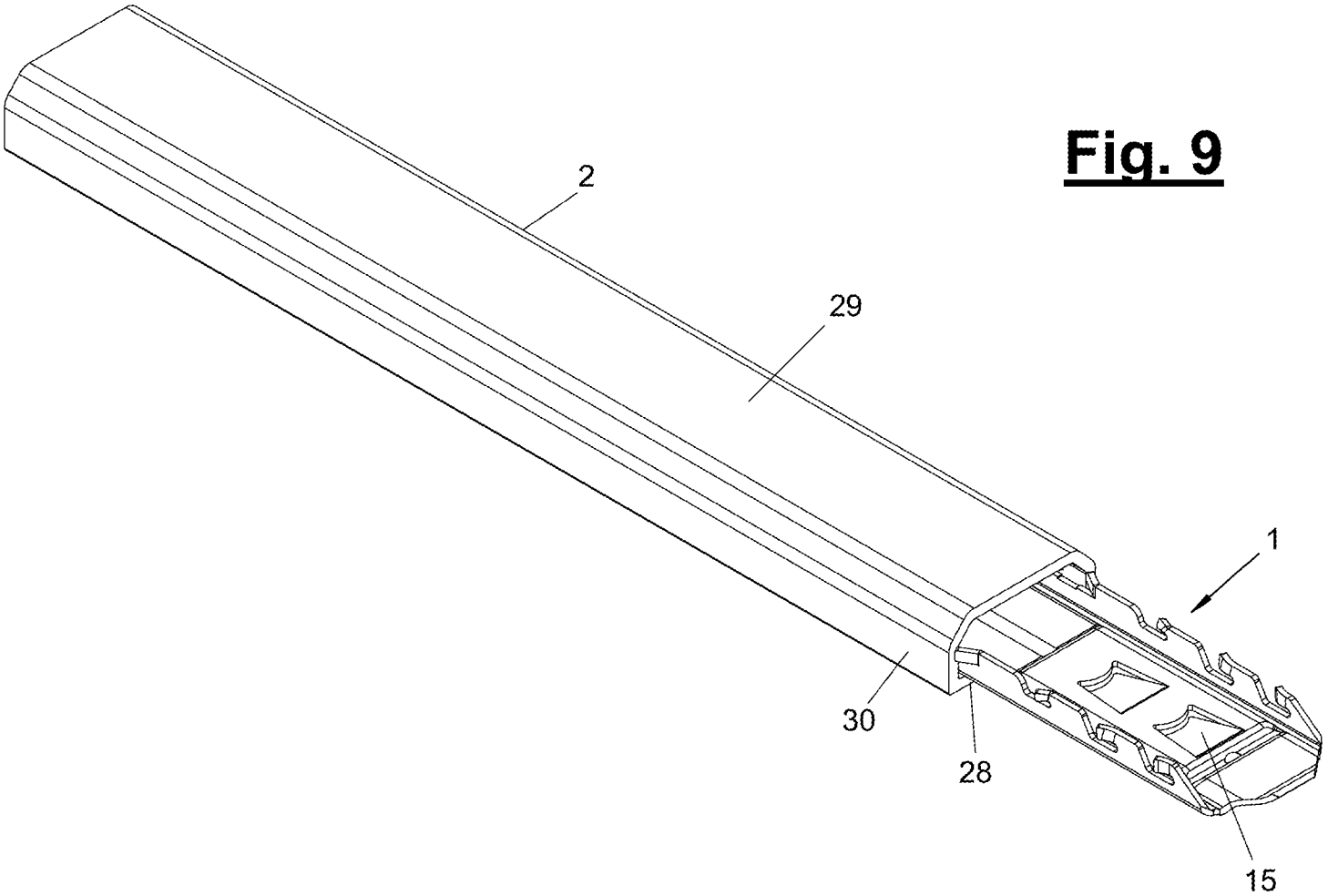
FIG. 9 is a perspective view showing the plug-in connector with a plugged-in hollow section end.
Figures 10, 12:
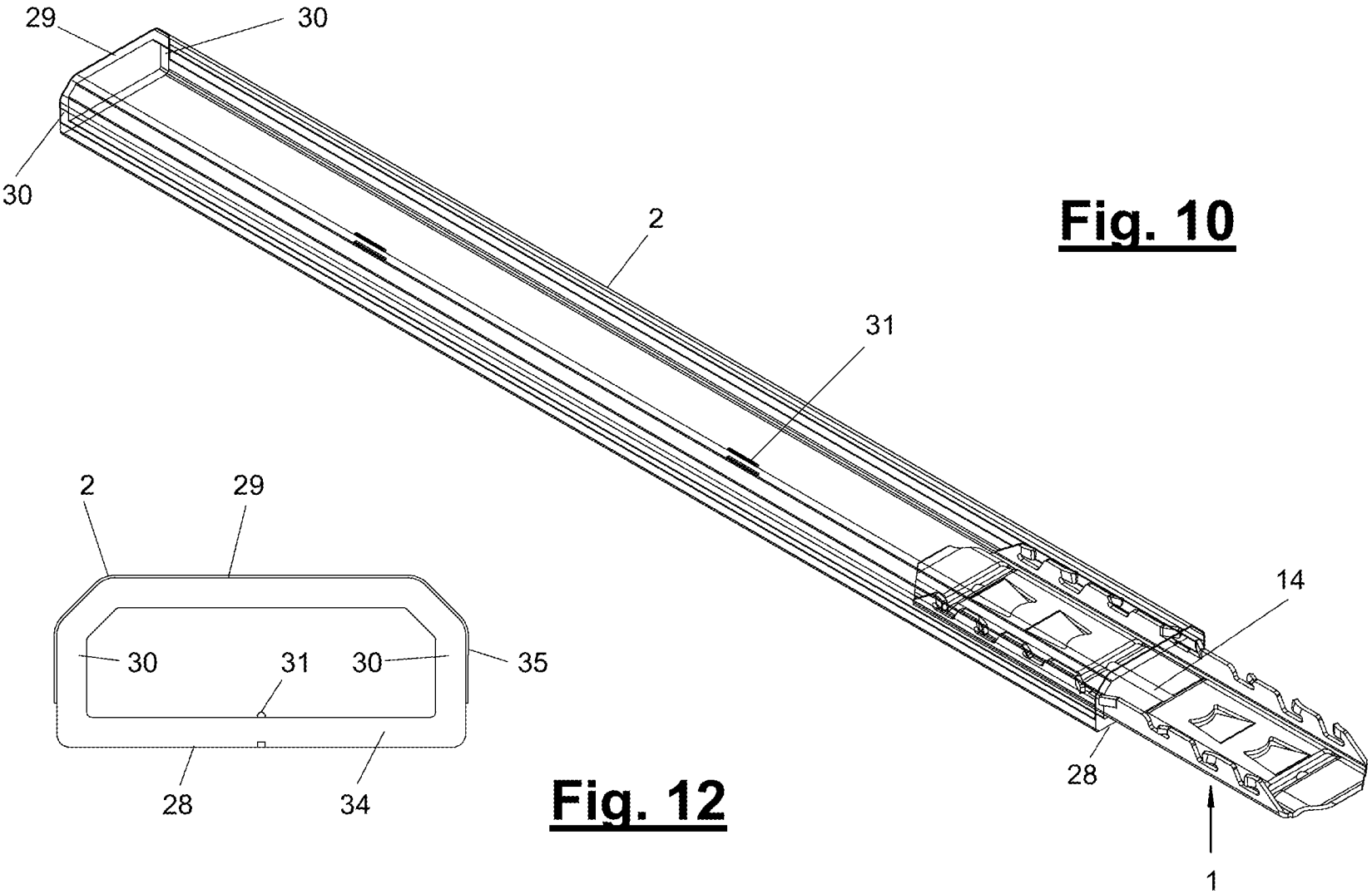
FIG. 10 is a perspective view showing the plug-in connector with a plugged-in hollow section end shown as transparent.
FIG. 12 is a sectional view of a plugged-in hollow section end.

FIGS. 1 through 11 show the plug-in connector (1) in different views. FIGS. 5, 9 and 10 show the plug-in position of the plug-in connector (1), plugged into a hollow section end (2) on one side. FIG. 12 shows a warm edge section (2), which is configured as a combined section of plastic (34) and metal (35).

The plug-in connector (1) is configured as a straight connector in the embodiments shown. As an alternative, it may be configured as a corner angle. The plug-in connector (1) has a center (3) and connector legs projecting therefrom in different directions. The connector legs are flush in the straight connector being shown. In a corner angle, they form an angle differing from 180° , e.g., an angle of 90° . The plug-in connector (1) has, in addition, a longitudinal axis (4), which extends along its legs and at right angles to the center line (3).

In the exemplary embodiments shown, the plug-in connector (1) has a bottom (5) with side walls (6) at the edges. In the installed position of the plug-in connector or in the plug-in connection, the bottom (5) points towards the bottom of the hollow section or hollow sections (2) and to the interior space between the panes of the insulating glazing. The side walls (6) adjoin the edges of the bottom at right angles or at an angle pointing slightly outwardly (V shape) and project in the direction opposite the roof (29) of the hollow section. The bottom (5) and the side walls (6) enclose an inner cavity (9), which extends in the axial direction up to the open end faces (8) of the plug-in connector (1). The cavity (9) is free and permits the flow of the granular desiccant over the junction points of the hollow section ends (2).

In the embodiments shown, the plug-in connector (1) has a U-shaped cross section, the U shape being open upwardly towards the roof (29) of the hollow section and to the outside of the insulating glazing. In another embodiment, the plug-in connector may be box-shaped with a bottom and with a wall part located opposite as well as with a cavity. It may have a tubular configuration in this case. The wall part may extend only over a part of the length of the connector and is located in the area of the center (3). It ensures sealing against the roof-side junction point of the hollow section ends (2). The plug-in connector (1) may block the flow of said granules in another variant. It may have, e.g., closed end faces (8) for this or it may have one or more stop walls at another suitable point. The plug-in connector (1) may optionally also have a massive configuration.

The plug-in connector (1) is configured as a stamping and bending part, especially one made of steel plate, in the exemplary embodiments being shown. The side walls or side webs (6) are bent off from a bottom (5) or central web here. In another embodiment, the plug-in connector (1) may consist of a plastic and be configured, e.g., as an injection-molded part. A configuration as a cast part is also possible. Likewise, the plug-in connector (1) may consist of any other suitable material, especially also a composite.

The preferably frame-shaped spacer of the insulating glazing may have one or more hollow sections (2). It may consist, for example, of a single, multiply bent hollow section, whose hollow section ends (2) are plugged on both sides onto the legs of the plug-in connector (1). In another embodiment, the spacer (frame) may be formed by a plurality of hollow section pieces, which are connected to one another via a plugged-in plug-in connector (1) in a corresponding manner. The connection point may be arranged on a straight section or on a corner area of the spacer frame. The spacer (frame) spaces apart adjacent glass panes of the insulating glazing.

FIG. 1 shows a perspective view of the outside of the bottom (5) of the plug-in connector (1). FIG. 3 shows the corresponding top view of the underside of the bottom. A plurality of resilient retaining elements (15) each are arranged on the bottom (5) on both sides of the center (3) of the plug-in connector (1). Two retaining elements (15) are present at each connector leg in the embodiments being shown. Their number may, as an alternative, be lower or higher. The retaining elements (15) on the bottom side have mutually identical configurations.

Viewed in the transverse direction of the plug-in connector (1), the retaining elements (15) are arranged centrally at the bottom (5). They are arranged in a single central row axially one after another. The individual row of connectors extends over both connector legs. The retaining elements (15) are located on the outside or underside of the bottom (5)

and are directed away from the bottom (5) obliquely outwardly and towards the adjacent hollow section wall (28), especially towards the bottom of the hollow section, and are in contact there. In addition, they are directed at the connector legs towards the center (3).

The retaining elements (15) can yield resiliently when pushing over a hollow section end (2) from the end face (8). The cross section of the plug-in connector (1) is adapted to the cross section of the hollow section, the retaining elements (15) having oversize and projecting over the bottom. They are resiliently depressed when plugging on a hollow section end (2) and absorb any possibly existing height tolerances as a result.

In the exemplary embodiments being shown, the bottom-side retaining elements (15) are configured as spring bosses, which start from the bottom (5). A bottom opening (17) with corresponding contours may be present in the bottom wall beneath the obliquely projecting retaining elements (15). In case of a stamping and bending part, the retaining elements or spring legs (15) may be cut free by a stamping cut and bent out obliquely. Bottom openings may be present or missing in case of an injection-molded or cast part made of a plastic, metal or the like.

The bottom-side retaining elements (15) have a concavely bent front edge (16). With this front edge (16), they are in contact with the plugged-in hollow section bottom (28). Projecting and rounded corner areas, which are in contact with the bottom of the connector at a laterally spaced location and on both sides of the central longitudinal axis (4) and dig in there when an extracting force develops, are formed due to the arched shape. The concave arch may possibly extend over central elevations (31) on the hollow section bottom (28) without contacting same or hook in there. As an alternative, the front edge (16) may be configured as a straight edge, which linearly meshes with the hollow section bottom (28).

The bottom-side retaining elements (15) are arranged in a recessed bottom area (13) on the outside of the bottom. As a result, the retaining elements or spring bosses (15) have an increased length, which is advantageous for their flexibility and makes possible a resilient and damage-free yielding when a hollow section (2) is plugged in.

As is illustrated in FIG. 1, the bottom (5) has a contoured shape on the outside with raised bottom areas (11, 12) and recessed bottom areas (13). The retaining elements (15) are arranged at axially spaced locations from the center (3) in such a recessed area (13).

A raised bottom area (11), which has the shape of a plate or base with an essentially flat outer surface, is present in the area of the center (3). Further, one or more rib-like or web-like raised bottom areas (12) are arranged at the end areas of the plug-in connector (1), which end areas are located on the end face. These are configured, e.g., as slender bottom ribs (12) oriented at right angles to the longitudinal axis (4). A recessed area (13) each is arranged at the connector legs between the central bottom plate (11) and the end-side bottom ribs (13). An additional recessed bottom area each may adjoin the bottom ribs (12) outwardly in the axial direction.

The recessed bottom areas (13) are defined axially by the front walls of the bottom plate (11) and of the bottom rib (12). Raised bottom edges, which adjoin the other raised bottom areas (11, 12) flush or essentially flush on the top side, are present laterally for limitation.

As is illustrated in FIGS. 1 and 10, the raised bottom areas (11, 12) on the outside may have an axial recess (14), which has, e.g., a groove-like configuration. The recesses (14) are arranged, e.g., centrally at the bottom (5) and extend along the axis (4). They may receive, e.g., elevations lined up axially at the bottom (28) of the hollow section, which are formed, e.g., by a central row of perforations (31), a connection seam or the like.

Figure 11:
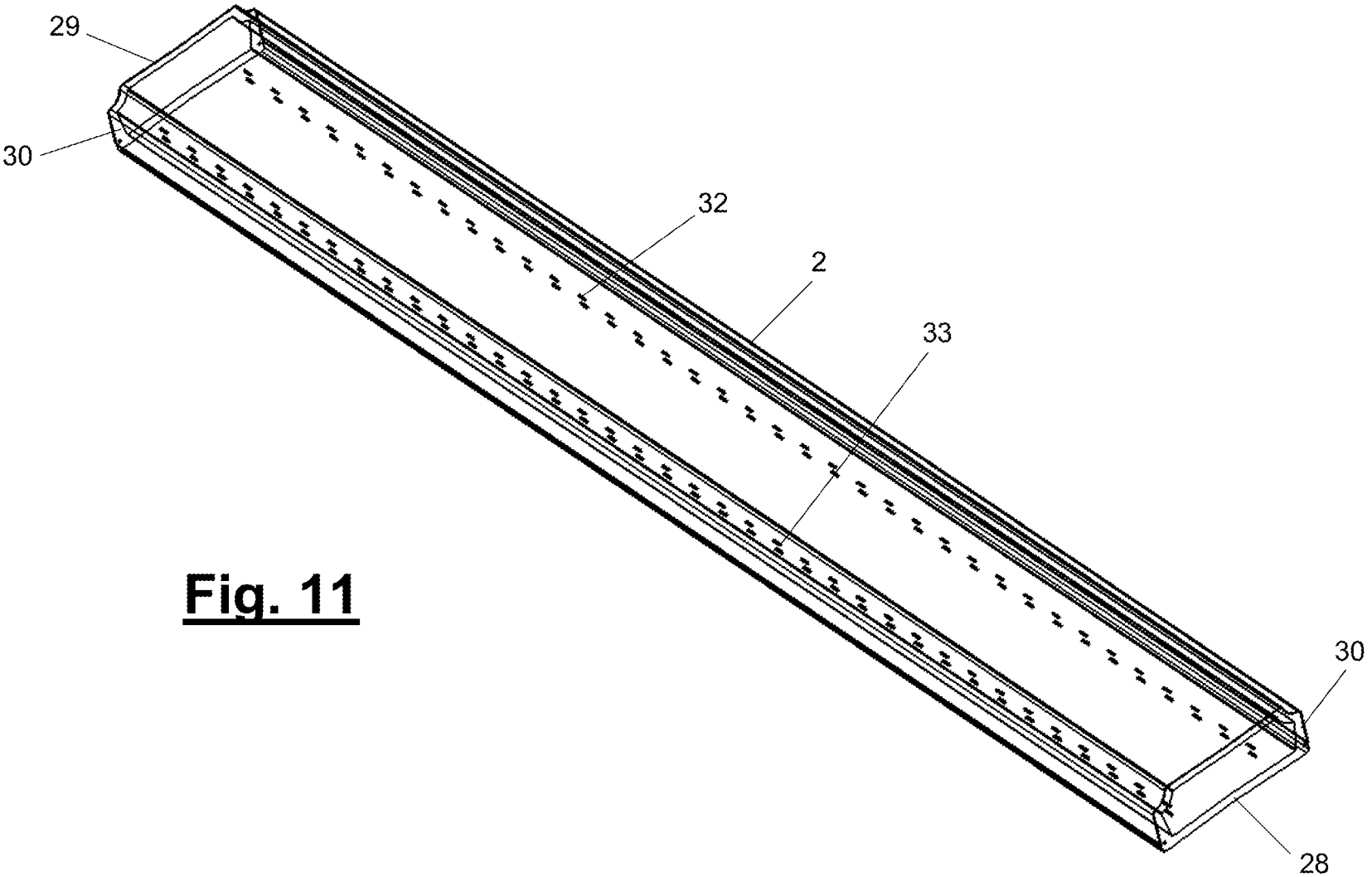
FIG. 11 is a perspective view showing the plug-in connector with a plugged-in hollow section end shown as transparent and showing perforations or elevations.

In one variant, shown in FIG. 11, a plurality of parallel axial rows 32, 33 of elevations, e.g., two such rows, as well as a correspondingly different number and arrangement of axial recesses (14) may be present. The latter may be arranged laterally offset and outside the retaining elements (15). The elevations and the recesses (14) may be arranged non-centrally in the vicinity of the longitudinal edges of the plug-in connector (1) and of the hollow section (2).

Figure 2:
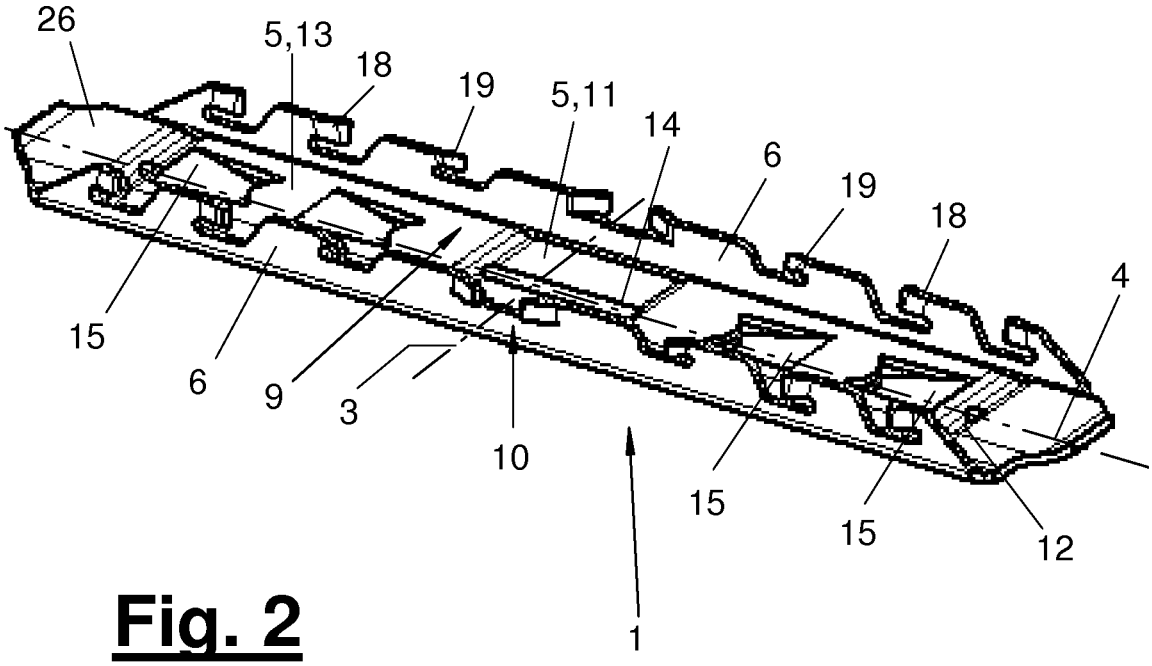
FIG. 2 is a perspective view of a plug-in connector with the view taken obliquely from the bottom.

FIG. 2 shows another perspective view of the rotated plug-in connector (1) with a view to the inside of the bottom (5) and to the cavity (9). On the inside, the bottom (5) may have the contour opposite its outside. FIGS. 4 and 5 show this shape of the bottom in a side view with representation in broken lines of the hidden bottom areas.

At the free edge area (7) of its side walls (6), the plug-in connector (1) has additional resilient retaining elements (18, 19), which project from the side wall (6) and are directed laterally obliquely outwardly. These retaining elements (18, 19) are likewise configured as spring bosses, which are each directed towards the center (3) starting from the side wall (6).

A wall opening (20) each is arranged in the side wall (6) beneath the lateral retaining elements (18, 19). The wall opening (20) has an undercut (21) under the respective retaining element (18, 19). The wall opening (20) extends, when viewed in the direction of the center (3), upwardly in front of the respective retaining element (18, 19) and opens at the free edge area (7). The undercut (21) broadens rearwardly in the opposite direction.

The lateral retaining elements (18, 19) have a wedge shape (24) broadening towards the center (3). They are broader and higher at their front free end pointing towards the center (3) than at their rearward transition point in the side wall (6). The flexibility is increased by this reduction of the cross section at the transition. The obliquely and laterally outwardly directed retaining elements (18, 19) can thus yield resiliently more easily and with reduced resistance when a hollow section end (2) is plugged in.

The lateral retaining elements (18, 19) are arranged at the two legs of the connector and at the respective bilateral side walls (6) of said legs. They absorb any existing side tolerances of the hollow section ends (2). Due to the weakening of the transition, the lateral retaining elements (18, 19) can also yield resiliently, if needed, upwardly and downwardly and in the principal plane of the side walls (6).

At their respective front end pointing towards the center (3), the lateral retaining elements (18, 19) have a straight front edge (23), by which they are linearly in contact with the side walls (30) of the plugged-in hollow section ends (2). The front edge (23) is directed essentially at right angles to the bottom (5) of the plug-in connector (1).

The lateral retaining elements (18, 19) have, further, a straight top edge or top side (22). This is directed in parallel to the bottom (5). An upper edge area (7) with a height remaining constant aside from the web openings (20) is obtained as a result.

The lateral retaining elements (18, 19) have different configurations in the embodiments shown. The lateral retaining elements (18) located directly adjacent to the center (3) at the connector legs are smaller and more flexurally rigid than the retaining element or retaining elements (19) following it in the direction of the respective end face (8). As an alternative, the lateral retaining elements (18, 19) may have a uniform configuration.

The plug-in connector (1) has a central stop (10) with fixed and/or resilient stop elements (25) for the plugged-in hollow section ends (2). There are different embodiment variants for this.

Figure 6:
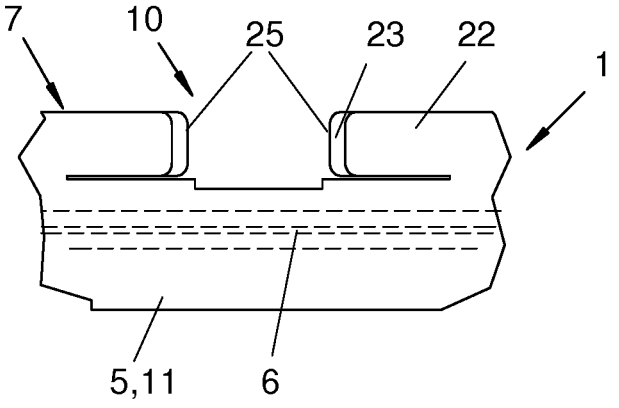
FIG. 6 is a cut-away and enlarged view of detail VI from FIG. 4.

The stop elements (25) are arranged at one side wall (6) and preferably at both side walls (6) in the embodiment being shown. They are configured each as spring bosses directed in pairs against one another and bent laterally outwardly. They are arranged in pairs mutually opposite each other on both sides of the center (3). In addition, they are located at axially spaced locations from one another on their outer end faces (23). The stop elements (25) are arranged, e.g., at the free edge area (7) of the side walls (6). They can be cut out of the respective side wall and bent obliquely outwardly. FIGS. 4 and 6 show the details of the central stop (10) and the stop elements (25) thereof A hollow section end (2) pushed over a connector leg moves over the first resiliently yielding stop element (25) and strikes the end face of the second stop element (25), which is directed in the opposite direction and acts as a stop. The second hollow section end (2) pushed over from the opposite side then strikes the first hollow section end (2) on the end faces. The junction point of the two hollow section ends (2) is located in the area of the center (3) of the plug-in connector (1) and is covered and sealed by the raised bottom plate (12) thereof at least in the bottom area.

In another embodiment of the central stop (10), a spring boss may be combined with a fixed stop located opposite on the other side of the center (3). Further, it is possible to use pure fixed stops, especially ramp-shaped or wedge-shaped fixed stops. These may be arranged at the side walls (6), e.g., at the end and diagonally offset over the center. In addition, fixed triangular or rib-shaped miniature stops (10) are possible. In another variant, a central stop (10) may also have a different configuration and also be arranged, further, at another point of the plug-in connector (1). In case of a corner angle, the corner area is correspondingly broadened and reinforced for the plugged-in hollow sections (2).

On its front sides (8), the plug-in connector (1) has a bottom lip (26) projecting axially over the edges of the side walls (6). This bottom lip has a laterally beveled shape tapering axially towards the front ends (8). The bottom lip (26) may have a straight and optionally obliquely upwardly bent front edge on the front side. Further, the bottom lip (26) may form a recessed bottom area when viewed from the outside of the bottom.

Figure 7:
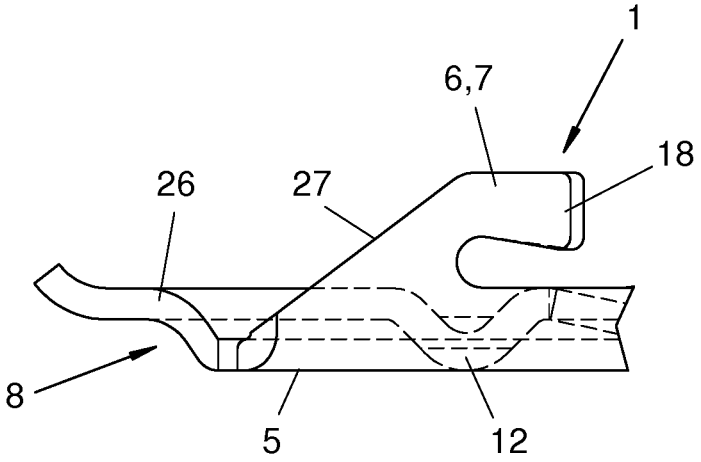
FIG. 7 is a cut-away and enlarged view of detail VII from FIG. 4.

The front edges of the side walls (6) have, according to FIGS. 4, 5 and 7, a bevel (27) rising from the bottom (5) towards the free edge area (7) and directed towards the center (3). This shape of the side walls (6) and of the bottom lip (26) facilitates the plugging in of the hollow section ends (2) and the pushing in of the connector legs into the hollow section ends.

Various variants of the embodiments shown are possible. In particular, the features of the exemplary embodiments may be combined with one another as desired and optionally also be replaced. The shape is also adapted in terms of manufacturing technology in case of a change in the material of the connector.

While specific embodiments of the invention have been shown and described in detail to illustrate the application of the principles of the invention, it will be understood that the invention may be embodied otherwise without departing from such principles.

The invention claimed is:

1. A plug-in connector for hollow sections having a hollow section wall of spacers of an insulating glazing, the plug-in connector comprising:

a bottom with recessed bottom areas and a raised, plate-shaped bottom area arranged in an area of a center, the recessed bottom areas adjoining the raised, plate-shaped bottom area;

side walls at bottom edges;

a plurality of bottom-side retaining elements, each of the bottom-side retaining elements being configured as a spring boss and arranged on an outside at the bottom in a single central row on both sides of the center of the plug-in connector, wherein said bottom-side retaining elements are directed, starting from the bottom, obliquely outwardly towards the adjacent hollow section wall and towards the center of the connector, wherein the bottom-side retaining elements are arranged on the outside of the bottom in the recessed bottom areas; and laterally obliquely outwardly directed, resilient, lateral retaining elements arranged at a free edge area of the side walls, said resilient, lateral retaining elements having a wedge shape with a straight front edge, said straight front edge being directed at right angles to the bottom and said wedge shape broadening in a direction towards the center.

2. A plug-in connector in accordance with claim 1, wherein the bottom-side retaining elements have a concavely bent front edge.

3. A plug-in connector in accordance with claim 1, wherein the bottom-side retaining elements have a mutually identical configuration.

4. A plug-in connector in accordance with claim 1, wherein the bottom has on the outside a raised, rib-shape bottom area arranged in the area of bottom ends.

5. A plug-in connector in accordance with claim 1, wherein the raised bottom areas on the outside have a groove- shape, axial recess.

6. A plug-in connector in accordance with claim 1, wherein the lateral retaining elements are configured as spring bosses, which start from the side wall and are directed each towards the center.

7. A plug-in connector in accordance with claim 1, wherein a wall opening is arranged beneath the lateral retaining elements.

8. A plug-in connector in accordance with claim 1, wherein the lateral retaining elements have a straight top edge, which is directed in parallel to the bottom.

9. A plug-in connector in accordance with claim 1, wherein:

the lateral retaining elements comprise center adjacent lateral retaining elements located directly adjacent to the center and one or more following lateral retaining elements following the center adjacent lateral retaining elements in a direction of a respective front side; and the center adjacent lateral retaining elements are smaller and more flexurally rigid than the following retaining element or following retaining elements following in the direction of the respective front side.

10. A plug-in connector in accordance with claim 1, wherein the plug-in connector is configured as a straight connector with flush connector legs arranged on both sides of the center.

11. A plug-in connector in accordance with claim 1, further comprising a central stop with fixed stop elements or resilient stop elements or both fixed and resilient stop elements.

12. A plug-in connector in accordance with claim 11, wherein the central stop is arranged on one or both longitudinal sides of the plug-in connector.

13. A plug-in connector in accordance with claim 11, wherein the stop elements are configured as laterally bent spring bosses directed against each other in pairs.

14. A plug-in connector in accordance with claim 1, further comprising a laterally beveled bottom lip projecting axially over the side walls and a bevel on the front edges of the side walls.

15. A plug-in connector in accordance with claim 1, wherein the plug-in connector has a U-shaped or box-shaped cross section with open front sides and with an inner free cavity for the passage of granules.

16. A plug-in connector in accordance with claim 1, wherein the plug-in connector is configured as a stamping and bending part from steel plate.

17. A plug-in connector according to claim 1 in combination with the hollow sections comprising the hollow section wall to form a plug-in connection for a hollow spacer of an insulating glazing, wherein the plug-in connection has front-side hollow section ends.

18. A plug-in connection in accordance with claim 17, wherein the hollow section ends at a hollow section bottom have a central axial row of perforations, which is received in the recesses of the plug-in connector.

19. A plug-in connection in accordance with claim 17, wherein the hollow section ends at the hollow section bottom have non-central axial rows of perforations, which are received in recesses of the plug-in connector.

20. A plug-in connection in accordance with claim 17, wherein the front-side hollow section ends each comprise a warm-edge hollow section configured as a combined section consisting of plastic and metal.

21. A plug-in connector for hollow sections for insulating glazing, the plug-in connector comprising:

a bottom with recessed bottom areas and a raised, plate-shaped bottom area arranged in an area of a center, the recessed bottom areas adjoining the raised, plate-shaped bottom area;

side walls at bottom edges;

a central stop with fixed stop elements or resilient stop elements or both fixed stop elements and resilient stop elements;

a plurality of bottom-side retaining elements, each of the bottom-side retaining elements being configured as a spring boss and arranged on an outside at the bottom in a single central row on both sides of the central stop, wherein said bottom-side retaining elements are directed, starting from the bottom, obliquely outwardly towards the adjacent hollow section wall and towards the center of the connector, wherein the bottom-side retaining elements are arranged on the outside of the bottom in the recessed bottom areas; and a plurality of lateral retaining elements, each of the lateral retaining element being laterally obliquely outwardly directed and being resilient and arranged at a free edge area of one of the side walls, said lateral retaining elements each having a wedge shape with a straight front edge, said straight front edge being directed at right angles to the bottom and said wedge shape broadening in a direction towards the center.

22. A plug-in connector according to claim 21, in combination with the hollow sections comprising the hollow section wall to form a plug-in connection for a hollow spacer of an insulating glazing, wherein the plug-in connection has front-side hollow section ends.

* * * * *